US005261572A

United States Patent [19]

Strater

[11] Patent Number: 5,261,572

[45] Date of Patent: Nov. 16, 1993

[54] DROPPER BOTTLE

[75] Inventor: William H. Strater, Fontana, Calif.

[73] Assignee: Plato Products, Inc., City of Industry, Calif.

[21] Appl. No.: 895,774

[22] Filed: Jun. 9, 1992

[51] Int. Cl.[5] ..... B65D 47/18

[52] U.S. Cl. ..... 222/215; 222/420; 604/240

[58] Field of Search ..... 222/206, 215, 420, 421, 222/422; 604/240, 243, 117

[56] References Cited

U.S. PATENT DOCUMENTS

| | | | |
|---|---|---|---|
| Re. 28,713 | 2/1976 | Stevens et al. | 604/240 |
| 3,638,650 | 2/1972 | Burke et al. | 604/240 |
| 4,049,160 | 9/1977 | Rumm | 222/215 |
| 4,138,040 | 2/1979 | Stock | 222/420 |
| 4,471,890 | 9/1984 | Dougherty | 222/420 X |
| 4,620,647 | 11/1986 | Woodworth et al. | 222/215 |

FOREIGN PATENT DOCUMENTS

| | | | |
|---|---|---|---|
| 61444/10033-47 | 5/1955 | France | 604/240 |

*Primary Examiner*—Andres Kashnikow
*Assistant Examiner*—Anthoula Pomrening
*Attorney, Agent, or Firm*—Christie, Parker & Hale

[57] ABSTRACT

A dropper bottle employs a conventional flexible bottle and cover with a conical tip having a hole in the end. An adapter is captured between the mouth of the bottle and cover and includes a generally conical extension. The extension seals inside the ferrule of a needle which is jammed inside the tip, with the needle protruding through the hole. The adapter seals between the mouth of the bottle and the ferrule of the needle and includes a passage for fluid between the bottle and the needle.

5 Claims, 1 Drawing Sheet

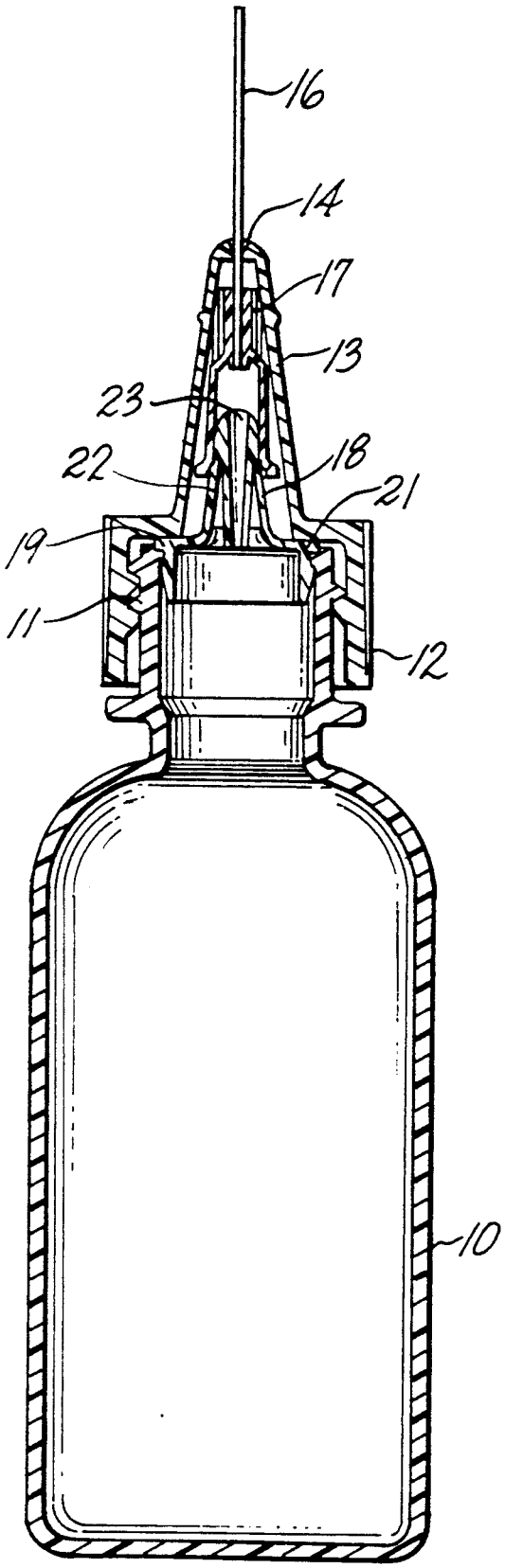
16
14
17
13
23
22
18
21
19
11
12
10

DROPPER BOTTLE

BACKGROUND

There are many settings where it is desirable to place a small drop or narrow line of liquid on a substrate. Flexible dispensing bottles for this purpose are readily available. A typical bottle is blow molded of polyethylene or other flexible plastic suitable for containing the desired liquid. A screw cover on the bottle has a conical extension with a hole in the end. A variety of liquids may be dispensed from such bottles such as soldering flux, solvents, glues, food products and the like.

Such a bottle is not always suitable since the tip is too coarse to fit in tight places or the hole is too large for placing a small amount of liquid in a tight space.

Other dropper bottles have therefore been devised where the cover includes a slender metal needle (typically stainless steel) through which liquid can be dispensed in a very fine stream or tiny droplet and the needle can reach into confined spaces. Securing the needle into the plastic cover of the bottle may be troublesome. Furthermore such dispensers are not adaptable for use of different sizes of needles. If a needle should become damaged or plugged the user typically throws away the whole bottle since replacement covers are not readily available.

Conventional bottles with a needle extending from the cover are difficult to package and deliver. A needle can be hazardous or easily damaged. Such a bottle may, therefore, have a protective sleeve placed over the needle. The needle protruding from the cover also adds appreciably to the height of the bottle and takes appreciable volume in the package for shipping.

It would therefor be desirable to have a needle which is removable from the cover and installed upon receipt by the user. It is also desirable to provide a dropper bottle with flexibility in the size of needle and with the ability to readily change needle sizes or replace needles as required.

BRIEF DESCRIPTION OF THE INVENTION

There is therefore provided in practice of this invention according to a presently preferred embodiment, a flexible plastic dropper bottle with a threaded cover having a conical tip extending away from the bottle and a hole in the end of the tip. A conventional needle of the sort having a ferrule on the end for fitting on a hypodermic syringe is placed inside the conical tip. A plastic adapter provides a seal against the mouth of the bottle, a seal against the ferrule of the needle, and a passage for passing fluid from the bottle to the ferrule. Such a needle may be stored inside the bottle during shipping.

DRAWING

The sole drawing in this application illustrates a dropper bottle in longitudinal cross-section.

DESCRIPTION

The dispenser bottle employs a conventional flexible plastic bottle 10, such as are readily commercially available, blow molded out of polyethylene or other plastic material. A two ounce bottle is convenient for practice of this invention, although other sizes are also suitable. The neck of the bottle has a male thread 11 for receiving a screw cover 12. The cover, which is typically also formed of high density polyethylene, includes a generally conical tip 13 with a hole 14 in the end for dispensing liquid.

In practice of this invention, a conventional needle 16, including a hollow ferrule 17, is jammed inside the conical tip. Such needles are readily available because they are commonly used on hypodermic syringes or the like. Such needles typically have diameters of 10 mils, 20 mils, 40 mils, etc. The hole in the conical tip is large enough to accomodate any of such sizes.

At the mouth of the bottle there is an adapter 18 which is typically injection molded of high density polyethylene or the like. The adapter has a partially tapered plug 19 which fits within the mouth of the bottle and keeps the adapter centered. At the outer end of the plug there is a circumferential flange 21 which is captured between the mouth of the bottle and the inside of the cover. The flange forms a fluid seal to the mouth of the bottle. The adapter also has a generally conical extension 22 extending away from the flange and into the ferrule of the needle. The extension fits tightly into the ferrule and provides a seal. It also jams the needle forwardly into the tip on the cover. A passage 23 through the adapter permits fluid to pass between the inside of the bottle and the needle.

With such an arrangement, a damaged or plugged needle can be readily replaced or a different size needle can be substituted by simply pressing the needle against a solid surface to force the needle and adapter out of the cover. The needle can then be pulled off of the adapter and replaced. The plug part of the adapter may be made a tight enough fit inside the bottle to remain on the bottle when the cover is removed.

When the bottle is delivered to the customer, a needle (or more than one needle) is dropped into the bottle and the adapter and cover are put in place on the bottle. Thus the bottle can be delivered without a hazardous needle which can be easily damaged protruding from the bottle.

Such a bottle is also useful for ejecting a tiny stream of air at a substantial velocity for blowing away contaminants on a surface. Conversely, the bottle can be squeezed and released so that the needle can be used for "vacuuming" liquids from a surface.

Although but one embodiment of dropper bottle constructed according to principles of this invention has been described and illustrated herein, adaptations will be apparent to those skilled in the art. Thus, for example, instead of having a plug and flange at the base of the adapter to keep it centered in the mouth of the bottle, one could simply provide a radiating flange which overlies the mouth of the bottle. An embodiment with a plug is preferred since it keeps the adapter centered in the bottle.

A flange large enough to center the adapter in a threaded cover has a number of problems. If it is made small enough to pass the thread it will not center unless a special cover is fabricated. Using the conical tip for centering can cause the adapter to jam inside the cover. Furthermore, the circumferential flange on an adapter with a plug can be made smaller than the mouth of the bottle to provide a high bearing pressure when installed, for an enhanced seal.

Since variations of this sort are possible, it will be understood that within the scope of the appended claims the invention may be practiced otherwise than as specifically described.

What is claimed is:

1. A dropper bottle comprising:

a bottle;

a cover on the bottle including a conical tip extending away from the bottle and a hole in an end of the conical tip;

a needle having a tip end extending through the hole and a ferrule end remaining inside the conical tip; and a removable adapter inside the cover including a first portion captured between the cover and the mouth of the bottle for sealing against the mouth of the bottle, a second portion sealing against the ferrule end of the needle, and a passage for passing fluid from the bottle to the ferrule end.

2. A dropper bottle as recited in claim 1 wherein the adapter includes a plug portion fitted into the mouth of the bottle.

3. A dropper bottle comprising:

a flexible plastic bottle;

a cover threaded on the bottle including a conical tip extending away from the bottle and a hole in an end of the conical tip;

a needle having a tip end extending through the hole and a ferrule end remaining inside the conical tip; and an adapter inside the cover, the adapter comprising:

a flange between the mouth of the bottle and the inside of the cover, a conical extension having an end portion in the ferrule end of the needle for sealing into the ferrule end; and a passage through the adapter for passing fluid from inside the bottle to the needle.

4. A dropper bottle as recited in claim 3 wherein the adapter includes a plug portion centered in the mouth of the bottle.

5. A dropper bottle as recited in claim 3 wherein the flange has a diameter smaller than the outside diameter of the mouth of the bottle.

* * * * *